United States Patent [19]

Janning

[11] Patent Number: 4,472,624

[45] Date of Patent: Sep. 18, 1984

[54] ELECTRIC RESISTANCE HEATER

[75] Inventor: James C. Janning, St. Louis County, Mo.

[73] Assignee: Emerson Electric Co., St. Louis, Mo.

[21] Appl. No.: 386,986

[22] Filed: Jun. 10, 1982

[51] Int. Cl.[3] ..... H05B 3/06

[52] U.S. Cl. ..... 219/532; D13/18; 174/138 J; 219/536; 219/375; 219/542; 338/304

[58] Field of Search ..... 219/354, 274, 275, 532, 219/536, 542; 338/286, 304; 174/138 J; D13/17, 18

[56] References Cited

U.S. PATENT DOCUMENTS

| | | | |
|---|---|---|---|
| D. 262,285 | 12/1981 | Janning | D13/18 |
| 1,024,234 | 4/1912 | Aller | 338/286 X |
| 1,844,678 | 2/1942 | Pickup | 219/532 |
| 2,921,172 | 1/1960 | Hackman | 219/532 |
| 3,016,441 | 1/1962 | Hackman et al. | 219/532 |
| 3,358,074 | 12/1967 | Himes | 174/138 |
| 3,543,002 | 11/1970 | Poole | 219/354 |
| 3,641,312 | 2/1972 | Ammerman et al. | 219/532 |
| 3,691,348 | 9/1972 | Kunz | 219/532 |
| 3,697,727 | 10/1972 | Newman et al. | 219/532 |
| 3,770,939 | 11/1973 | Kokjohn | 219/532 |
| 3,846,619 | 11/1974 | Wightman et al. | 219/532 |
| 3,890,487 | 6/1975 | Wightman et al. | 219/532 |
| 4,250,399 | 2/1981 | King | 219/532 |
| 4,268,742 | 5/1981 | Cottrell | 219/532 |
| 4,363,959 | 12/1982 | Cottrell et al. | 219/532 |

*Primary Examiner*—Volodymyr Y. Mayewsky

*Attorney, Agent, or Firm*—Polster, Polster & Lucchesi

[57] ABSTRACT

A heater is disclosed having an elongate wire heating element with the heating element including at least two generally parallel runs supported on a frame by insulators with the portion of the heating element consituting the runs being formed generally in a helical coil and with the portion of the heating element between the runs being referred to as a turnaround. Specifically, the turnarounds are of non-helical coil construction and have at least one loop therein between the insulators supporting adjacent runs of the heating element thereby to permit limited movement between the adjacent runs and to permit thermal expansion and contraction of the turnarounds without applying a substantial force to the insulators. Further, the insulators are constructed so as to engage three convolutions of the coiled helical heating element runs with the intermediate engaged coil convolution being resiliently deflected inwardly toward the central longitudinal axis of the helical coil thereby to aid in resiliently retaining the run of the heating element on the insulator.

3 Claims, 6 Drawing Figures

ELECTRIC RESISTANCE HEATER

BACKGROUND OF THE INVENTION

This invention relates to electrical resistance heaters, and more particularly to such heaters in which the heating element is formed of electrical resistance heating wire, of nichrome or the like, and even more particularly in which the heating element is formed in a helical coil and in which the heating element is supported on a frame or the like by means of ceramic-like insulators. Such heating elements find a wide range of applications, such as in electric clothes dryers, resistance heating systems for residential and in commercial heating and ventilating systems.

Heretofore, electrical resistance heating elements, such as described above, were mounted on a metal frame and were carried by ceramic electrical insulators thereby to electrically isolate the heating element from the frame. As shown in U.S. Pat. No. 3,697,727, these insulators were typically hollow collars or bushings through which the coiled electric resistance heating element was inserted. However, it has been found that these ring-like insulator collars were not entirely desirable because air flow through the collars was somewhat limited and thus increased significantly the surface temperature of the electric resistance heating element within the collar several hundred degrees Fahrenheit above the temperature of the heating element exposed to air flow thereover. This increased temperature of the heating element within the collars deleteriously affected service life of the heating element because of increased rates of oxidation of the heating element wire. Further, the insulator bushings did not securely fasten or anchor the heating coils and, during repeated firing and unfiring of the heating element, the coils would slide on the collars and abrade the heating element, weakening it and leading to reduced service life of the heating coil.

Additionally, as is typically illustrated in the above-noted U.S. Pat. No. 3,697,727, the heating element was typically of helical coil construction from one end to the other with the heating coil being formed in a generally serpentine arrangement with the parallel portions of the heating element constituting runs and with the portions of the heating element interconnecting adjacent runs being referred to as turnarounds. Typically, such a continuous, coiled heating element is installed in an air duct or the like through which air may be forceably circulated thereby to transfer heat from the heating element to the air flowing therethrough. This compact, serpentine design of the heating element is desirable because it maximizes circulation of the air over the heating element and thus enhances heat transfer to the air. However, the lengths of the heating element runs which are freely supported between the insulators tend to lose strength when heated or fired and, over time, the weight of the coiled helical heating element hanging between the insulators could cause the heating elements to sag. This sagging is particularly undesirable because if the heating element sags beyond a certain degree because the heating element may break or may contact the sidewalls of the duct within which it is installed or the frame carrying the heating element thus shorting out the heating element. Therefore, there has been a longstanding need to support the heating element so as to eliminate or lessen the tendency of the unsupported lengths of a colied heating element to sag.

Further, it has heretofore been conventional to form the entire length of the heating element of helical coiled construction including not only the runs of the heating element supported between the insulators, but also the turnaround portions interconnecting one run of the heating element with another. It will be appreciated that as the helical heating element is turned on itself in the turnaround, the portion of the helical coils on the inside radius of the turnaround come much closer together. This has a particularly deleterious effect on the heating element because the closer spacing of the coils significantly changes the reradiation coefficients of the coils relative to one another thereby significantly increasing the temperature of the more closely spaced coil portions and, as heretofore pointed out, increased temperature levels of the coils results in reduced service life due to increased oxidation of the coils.

Still further, the requirement of having to use solid circular insulator collars required more time to assemble the heating element because the insulator collars had to be threaded onto the continuous length of the heating element.

Reference made to such U.S. Pat. Nos. as 1,844,678, 2,921,172, 3,016,441, 3,358,074, 3,641,312, 3,770,939, 3,846,619, 3,890,487 and U.S. Pat. No. Des. 262,285 for prior art references in the same general field as the present invention.

SUMMARY OF THE INVENTION

Among the several objects and features of this invention may be noted the provision of an electrical resistance heater having a heating element of electrical resistance wire with the runs of the heating element being of coiled helical construction but with the turnarounds between adjacent runs being of non-helical coiled construction thereby to significantly reduce the temperature of the electrical heating wire in the turnaround areas and to significantly increase the service life of the heating element;

The provision of such a heating element in which the insulators contact three adjacent convolutions of the helical coiled heating element at only localized points therearound thereby to permit air circulation to flow freely ocer the convolutions supported by the insulators;

The provision of such an electrical resistance heater in which the heating element may be formed to its desired configuration and readily applied to the insulators already installed on the frame for the heating element;

The provision of such an electrical resistance heater which permits the ready field repair of the heating element, even after the heating element has been fired, without undue breakage of the heating element;

The provision of such an electrical resistance heater which supports the runs of the heating element in such manner as to lessen the tendency of the heating element to sag; and The provision of such a heating element which is of simple and rugged construction, which is easy to assembly, which requires less labor to manufacture, which has a longer service life, and which is more readily field repairable that prior heating elements.

Other objects and features of this invention will be in part pointed out and in part apparent hereinafter.

Briefly stated, in an electrical resistance heater, the heater has an elongate wire heating element having at least two generally parallel runs with the portion of the heating element between the runs being referred to as a turnaround and with the ends of the heating element being adapted for the connection of electrical power thereto for energization of the heater. As is typical, the heater includes a frame and a plurality of insulators for supporting the heating element on the frame. The runs of the heating element are of generally helical coiled form construction and each of the helical coiled runs has a plurality of convolutions therein and a central axis generally coaxial with the convolutions. More specifically, the improvement of this invention comprises constructing the turnarounds so as to be of non-helical construction and so as to have at least one loop therein between the insulators supporting adjacent runs thereby to permit limited relative movement between the adjacent runs and to permit thermal expansion and contraction of the turnaround without placing undue force on the insulators.

Further, this invention includes the provision of insulators having first and second notches in respective sides of the insulators facing in generally opposite direction with respect to the longitudinal central axis of the run and having an intermediate notch in an intermediate side of the insulator between the first and second notches and facing toward the longitudinal centeraxis of the run, the first and second notches being inclined generally with respect to the axial center axis of the run thereby to substantially restrain movement of the convolutions of the coil received therein against axial movement and with the intermediate notch having sides engageable with the convolution received therein so as to prevent substantial axial movement of the coil. In a preferred embodiment of the insulator, the intermediate notch is spaced more closely radially inwardly toward the longitudinal centeraxis of the coil such that the convolution of the run received in the intermediate notch is resiliently displaced from the longitudinal centeraxis of the coil thereby to impose a resilient force on the coil which aids in restraining the coil against both sagging and axial movement, even after firing of the heating element.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
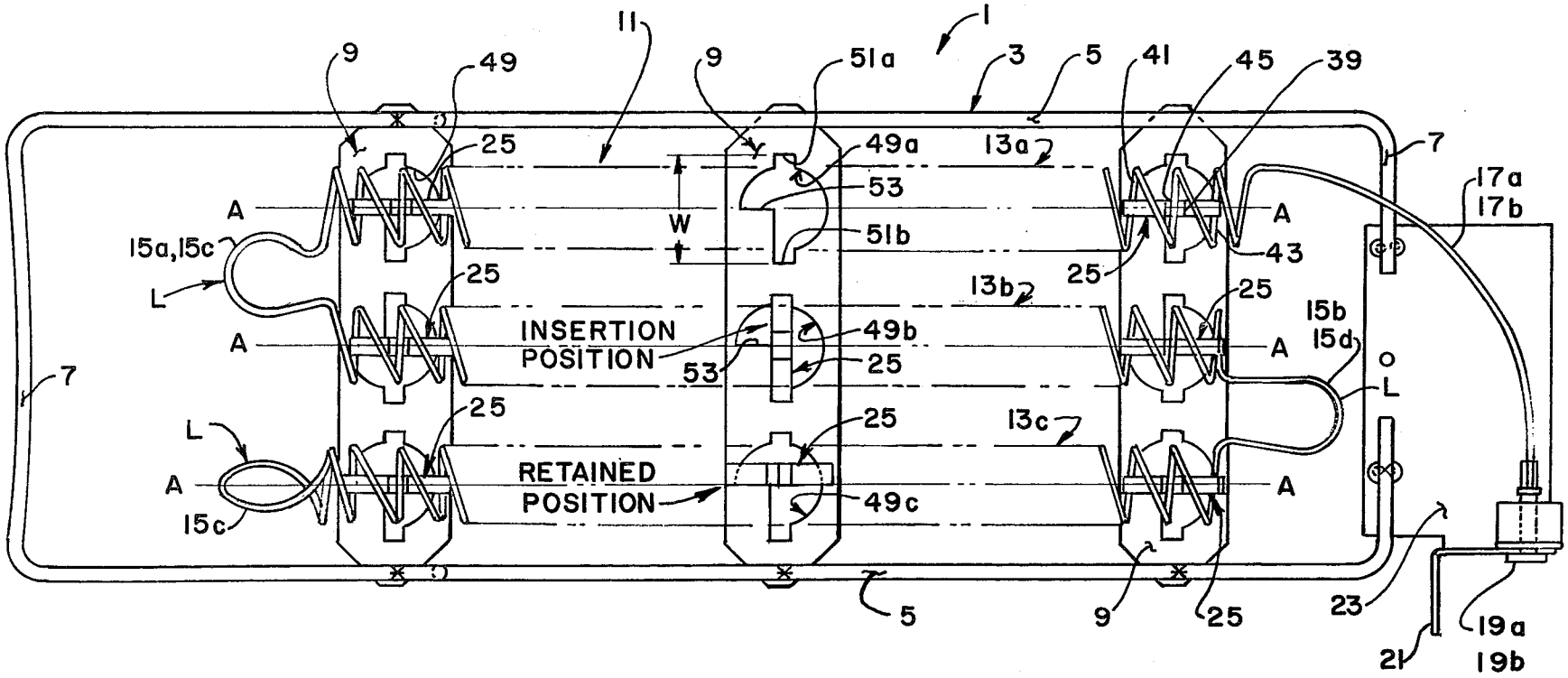
FIG. 1 is a top plan view of an electrical resistance heater assembly of the present invention having six runs of the heating element with three of the runs on one side of the heating element being generally coplanar and with the other three runs being on the other side of the heating element and being generally coplanar.

Referring now to the drawings, an electrical resistance heater in accordance with this invention is generally indicated in its entirety by reference character 1. While those skilled in the art will appreciate that the broader aspects of this invention may be applied to virtually any type of electrical resistance heater using an elongate, coiled electric resistance heating element, heater 1 shown in the drawings and discussed herein is a heating element for a residential clothes dryer which is intended to be installed in a heater box through which air is drawn, heated by the heating element, and discharged into the clothes drum for drying purposes.

More specifically, heater 1 includes a frame, as generally indicated at 3, having side bars or rods 5 extending longitudinally of the frame and having ends 7 at each end thereof. As shown, frame 3 is constituted by a one-piece, formed rod and the frame has three support bars or plates 9 extending transversely between side members 5 for supporting the heating element in a manner as will appear. Each of the support bars is of formed sheet metal and is secured (e.g., welded) at its ends to side rods 5.

Figure 2:
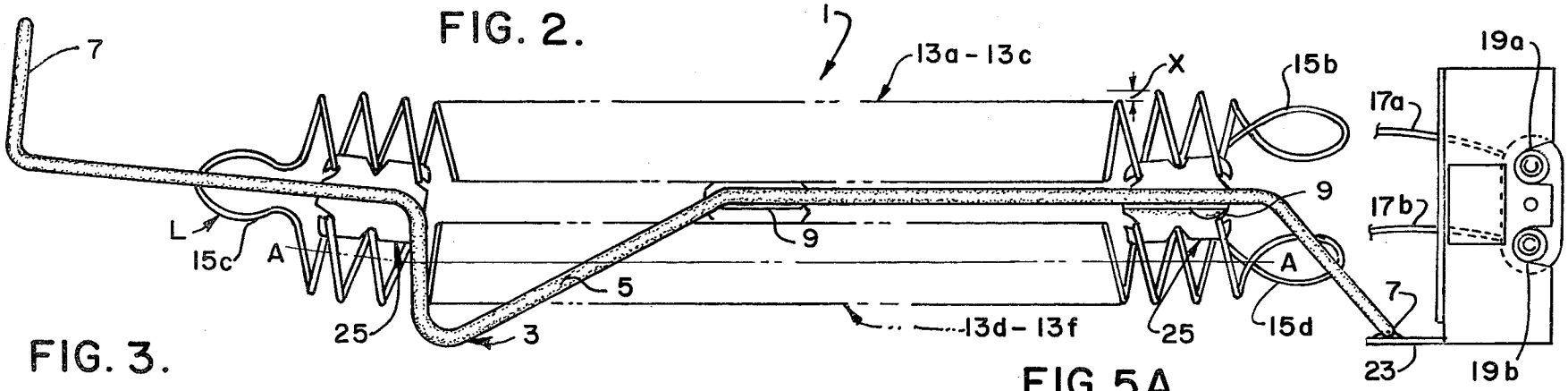
FIG. 2 is a side elevational view of FIG. 1.
Figure 3:
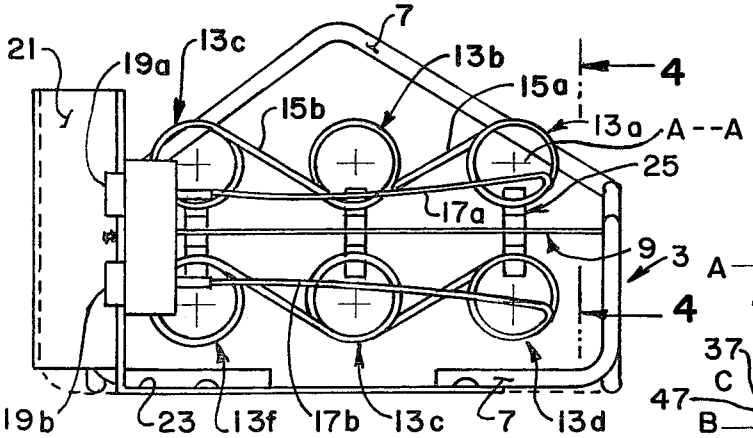
FIG. 3 is a right end elevational view of the heating assembly shown in FIG. 1.

As generally indicated at 11, a heating element is mounted on the support bars 9 of frame 3 by means of insulators (a description of which will appear in detail hereinafter). As is typical, heating element 11 is a continuous length of suitable electrical resistance heating wire, such as Nichrome or the like, and such as is well known to those skilled in the art. As shown, heating element 11 has a plurality (e.g., six) of heating element runs **13*a*–13*f* extending generally parallel to one another with three of the runs 13*a*–13*c* being located on one side of support bars 9 and with the other three runs 13*d*–13*f* being located on the other side of the support bars. As shown, each of the runs is constituted by a longitudinal helical coil of the electrical resistance heating wire with the coil having a multiplicity of generally uniformly spaced convolutions and having center helical axis, as indicated by A—A in FIGS. 1–3**.

In accordance with this invention, each of the adjacent runs **13*a*–13*f* of the heating element 11 are electrically connected in series to an adjacent run of the coil by means of a so-called turnaround, as indicated at 15*a*–15*e*. More specifically, it will be noted that each of the turnarounds is not of helical coil construction, but rather each of the turnarounds 15*a*–15*e* has a defined length of heating element wire therein and each of the turnarounds includes a partially closed loop, as generally indicated at L, electrically connecting the end of one heating element run (e.g., run 13*a*) with the end of the next adjacent run (e.g., run 13*b*) in series therewith thereby to provide electrical continuity from one end of heating element 11 to the other. As shown, loops L are substantially longer than the distance between the adjacent heating element runs. Further, the construction of the partially closed loops L permits significant movement of the adjacent heating element runs relative to one another upon firing and unfiring of the heater element and upon the circulation of air thereover without placing undue strain on the heating element, particularly after it has been fired, as this may cause premature failure of the heating element. Still further, it will be noted that on account of the open construction of the turnarounds 15*a*–15*e*, the turnarounds are exposed to the air flowing over the heating elements and the various portions of the turnarounds are spaced relatively far from one another such that reradiation of radiant thermal energy from one portion of the turnaround to the other does not cause excessive heating of the turnaround wires thereby to enhance the service life of heating element 11**.

In addition to the helical coiled runs 13*a*–13*b* and the looped end turns 15*a*–15*f*, as above described, heating element 11 includes a pair of leads, as indicated at 17*a*, 17*b*, integral with the heating elements and constituting the ends of heating element 11 with these leads being electrically connected to respective electrical terminals 19*a*, 19*b*. Those skilled in the art will recognize that the terminals 19*a*, 19*b* may be connected to a source of electrical power for energization of heating element 11 in the conventional manner. Further, frame 3 for heating element 1 comprises a terminal support bracket 21. The support bracket is carried by a plate 23 which is secured to one end 7 of frame 3.

Figure 4:
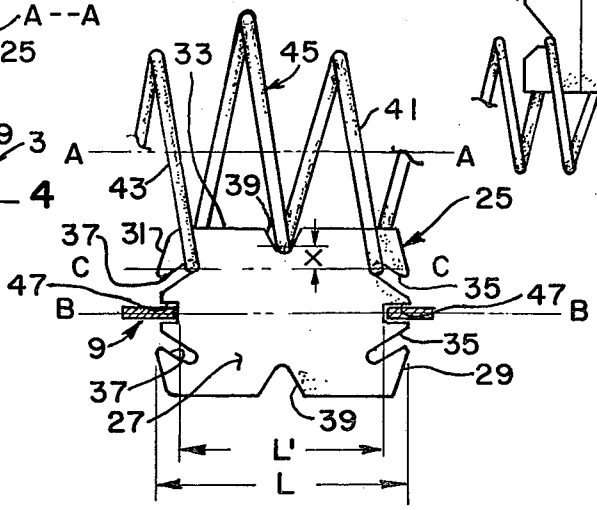
FIG. 4 is a cross-sectional view taken along line 4—4 of FIG. 3 illustrating an insulator for supporting two runs of the heating element (only one run is illustrated) on the frame of the heating assembly.

As previously mentioned, runs 13*a*–13*f* of heating element 11 are supported on electrical and thermal insulators, each of which is generally indicated at 25, thereby to hold the heating element 11 clear of frame 3 and to support the heating element during energization. As shown best in FIG. 2, each insulator 25 is carried by a respective support bar 9 and has the provision on both its upper and lower faces (as viewed in FIG. 2) of securing and supporting a respective run of heating element 11 in such manner as to maximize heat transfer from the convolutions of the heating element engageable with the insulator thereby to minimize the operating temperature of the portions of the heating coil supported by the insulator and also so as to support the heating coil in such manner as to minimize sag of the helical coil heating element extending between the insulators. As shown in FIG.4, insulator 25 is generally symmetrical about an axis, or plane, as indicated by B—B and thus only the upper portion of the insulator, as shown in FIG. 4, will be described in detail. However, those skilled in the art will recognize that the bottom portion of the insulator is essentially identical and operates to support its respective heating element run in the same manner as will hereinafter be described. Further, while insulators 2 are herein shown and described as supporting an upper and a lower coil, the insulators 25 need not be vertically oriented and may support the heater runs to the side of the insulator, or at any other desired angle.

As is conventional, insulator 25 is preferably made of a ceramic-like material, for example steatite, so as to electrically insulate heating element 11 from frame 3 and also so as to thermally insulate the heating element and to prevent undue conduction of heat away from the portions of the heating element in contact with the insulator.

Further, insulator 25 is constituted by a body 27 of the steatite material (or of other ceramic electrical insulative material) with the body having a width or thickness T, as shown in FIG. 1, and having an overall length, as indicated by dimension L in FIG. 4. As shown in FIG. 4, insulator 25 has a first side 29 (i.e., the right side as shown in FIG. 4) and a second side, as indicated at 31. Further, the insulator has an intermediate or top side 33 extending between the first and second sides. In accordance with this invention, first side 29 has an upwardly inclined blind notch, as indicated at 35, provided therein and side 31 has a similar respective inclined notch 37 therein. Further, the upper or intermediate side 33 of the insulator has an intermediate notch 39 provided therein. The width of the upwardly inclined notches 35 and 37 is somewhat wider than the thickness of electrical resistance heating wire 11. As shown in FIG. 4, the inner blind ends of each of the side notches 35 and 37 are formed in a radius so as to engage and support only a segment of a respective convolution 41 or 43 of a respective run 13*a*–13*f* of heating element 11 in engagement with the insulator. As is best shown in FIG. 4, the portion of the convolutions 41 and 43 of the heating element runs received in notches 35 and 37 are generally coplanar, as indicated by axis C—C. In one embodiment of the insulator of this invention, the bottom of intermediate notch 39 is spaced above the level of coplanar axis C—C of the ends of notches 35 and 37 by an offset distance, as indicated at X in FIG. 4. Thus, upon installing a respective heating element run 13*a*–13*f* on a respective insulator 25, a first convolution, as indicated at 41, is first placed in its respective notch 35 and then the heating coil is bent along its helical axis A—A such that the bottom of the adjacent intermediate convolution 45 may be placed in intermediate notch 39. The coil is further flexed and convolution 43 is inserted in its respective inclined slot 37. When the coil is released, the bottom of convolutions 41 and 43 will resiliently spring upwardly and be restrained against further upward movement by the closed end of the inclined slots 35 and 37. However, because of the offset distance X between the inner ends of the blind slots 35 and 37 relative to the bottom of intermediate slot 39, convolution 45 is displaced outwardly away from the center axis A—A of the helical heating coil and thus a resilient restraining force is applied to the helical coil as it extends from one insulator 25 to the next adjacent heating element which tends to hold the coiled heating element in place on insulator 5 regardless of the orientation of the heating element or the insulator. Those skilled in the art will appreciate that the offset of intermediate convolution 45 due to the offset distance X of the three slots applies a resilient restoring force to the heating element coil such that after even repeated firing (or heating) of the heater coil, this restorative, resilient force will tend to minimize sagging of the heating coil between adjacent insulators 25 thus eliminating or lessening a primary cause of heating element failure, viz., excessive heating coil sag. Further, the coil is positively prevented from moving in axial direction with respect to insulator 25. However, within the broader aspects of this invention, intermediate notch 39 need not be axially offset from the plane C—C of notch ends 35 and 37 and still the heating element coil will be positively restrained against axial movement relative to insulator 25.

Figure 5B:
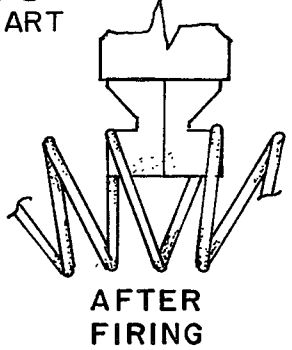
FIG. 5B. PRIOR ART
FIGS. 5A and 5B illustrate a prior art insulator and a helical coil heating element before firing and after firing with FIG. 5B illustrating the tendency of prior art insulators to permit the heating element to sag after firing.
Figure 5A:
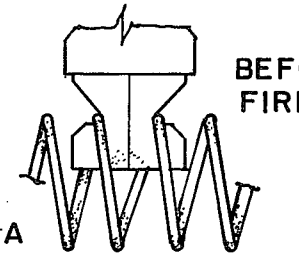
FIG. 5A. PRIOR ART

Referring to FIGS. 5A and 5B, a known prior art open insulator (as opposed to a collar type insulator which supports only two of the adjacent convolutions of the coil) is illustrated. As illustrated in FIG. 5A, prior to firing or repeated heating of the heating element, the adjacent convolutions of the coil remain in relatively tightly spaced firm engagement with notches provided on opposite faces of the insulator. However, as illustrated in FIG. 5B, after repeated firing or heating of the coil, the weight of the coil supported between adjacent insulators acts like a hanging chain or catenary and applies an axial tension load to the coil which tends to pull it out of its notches. As can be appreciated from FIG. 5B, any further movement of the supported convolutions relative to the insulator may result in the heating element falling clear of the insulator which would cause the heating element either to break or to short out on the metal frame. However, in contradistinction, the provision of the intermediate notch 39 of insulator 25 of the instant invention positively prevents axial movement of the heating element relative to the insulator and thus, even though the catenary forces acting on the lengths of the heating coil extending between the inclined slots 35 and 37 in the sides of the insulator to the next adjacent insulator may move relative to the insulator, the fixed position of intermediate convolution 45 relative to the intermediate slot 39 positively prevents overall axial movement of the heating element run relative to the insulator.

As will be further appreciated by those skilled in the art, because only a relatively short segment of each of the convolutions 41–45 is in contact with the insulator because substantial air flow can still be directed over a considerable surface area of the segment of the heating element in contact with the insulator, and further because of the heat conduction properties of the insulator, insulator 25 of the present invention prevents or lessens the undue temperature buildup of the heating element in contact with the insulator and thus prolongs service life of heating element 11.

Still further in accordance with this invention, insulators 25 are so constructed such that they may be readily inserted into support bars 9, positively retained in their installed position, and further such that the completely formed heating element 11 including helical coil runs 13*a*–13*b* and the turnarounds 15*a*–15*e* may be readily and efficiently installed on the insulators, one insulator at a time, without the necessity of having to thread the insulators through the serpentine heating element as was heretofore conventional when collar type insulators were used.

More particularly, insulator 25 (see FIG. 4) is shown to have a pair of notches 47 in its first and second sides generally coincident with symmetrical axis B—B and with the inner bases of these notches being spaced apart from one another by a length, as indicated by dimension L'. Further, as shown in FIG. 1, each of the support bars 9 of frame 3 has a plurality of apertures (e.g., three) as generally indicated by reference characters 49*a*–49*b*, one aperture for each insulator 25 to be carried by the support bar. More specifically, each aperture is identical and thus only aperture 49*a*, as illustrated in FIG. 1, will be described in detail. Specifically, aperture 49*a* is shown to have a generally circular opening with a pair of diametrically opposed rectangular notches 51*a*–51*b*. Further, a stop 53 is optionally provided within the generally circular aperture. It will be understood that the outer extremities of notches 51*a*, 51*b* are spaced apart by a dimension W (see FIG. 1) which is somewhat larger than the overall length L (see FIG. 4) of insulator 25 and the width of the slots 51*a*, 51*b* is somewhat wider that the thickness T of the insulator such that the insulator may be inserted freely through notches 51*a*, 51*b* and aperture 49. With the insulator inserted approximately halfway through the aperture 49, as it appears in FIG. 2, the insulator may be rotated in counterclockwise direction (as viewed in FIG. 1) such that slots 47 in the sides of the insulator will engage the portion of sidebar 9 defining the circular portion of aperture 49 thereby to prevent up and down movement (as viewed in FIGS. 2 and 3) of the insulator relative to the support bar. Upon rotating the insulator in counterclockwise direction approximately 90° to the position of the insulator shown in FIG. 1, one face of the insulator will engage stop 53 thereby properly aligning the insulator with respect to the support bars. It will be appreciated in this manner, insulators 25 may readily be inserted into the frame and secured in place without even the requirement of simple handtools.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

We claim:

1. In an electrical resistance heater having an elongate wire heating element with at least two generally parallel runs of the heating element and with the portion of the heating element between the runs being referred to as a turnaround and further with the ends of the heating element being adapted for the connection of electrical power thereto, a frame, and a plurality of insulators for supporting said heating element on said frame, said runs of said heating element being a generally helical coil of said wire heating element, said helical coil having a plurality of convolutions and a central axis generally coaxial with said convolutions, wherein the improvement comprises:

said insulator having a first side and a second side facing in generally opposite directions generally in line with the central longitudinal axis of said helical coil of its respective heating element run and having an intermediate side facing generally toward said run;

said first and second side of said insulator each having an inclined blind notch therein inclined inwardly and toward said intermediate side, said intermediate side having an intermediate notch therein, the base of said intermediate notch being offset a predetermined distance toward said center axis of said helical coil of said heater run relative to the ends of said first and second blind slots, said first and second notches and said intermediate notches each being adapted to receive a segment of a respective adjacent convolution of said coil whereby the convolution received in said intermediate notch is resiliently offset by said predetermined distance toward said centeraxis of said helical coil thereby to apply a resilient restraining force on said heating element run so as to minimize sagging of the heating element run after firing and so as to positively prevent axial shifting movement of said heating element run relative to said insulator.

2. In a heater as set forth in claim 1 wherein said frame has an aperture therein for receiving a respective insulator, said insulator having a groove therein, the width of said groove being somewhat wider than the thickness of said frame in which said aperture is located, said aperture having a generally circular portion of a diameter somewhat greater than the distance between the base of said groove on one side of said insulator and the base of said groove on the other side of said insulator, said aperture having at least one blind slot therein with the distance from the end of the blind spot to the opposite diametric side of the aperture being somewhat greater than the width of the insulator whereby the insulator may be inserted into the aperture and, with said grooves in register with the portions of the support plate defining said circular portion of said aperture, said insulator being rotatable relative to said support plate from its insertion position to a retained position.

3. In an electrical resistance heater having an elongate wire heating element with at least two generally parallel runs of the heating element and with the portion of the heating element between the runs being referred to as a turnaround and further with the ends of the heating element being adapted for the connection of electrical power thereto, a frame, and a plurality of insulators for supporting said heating element on said frame, said runs of said heating element being a generally helical coil of said wire heating element, said helical coil having a plurality of convolutions and a central axis generally coaxial with said convolutions, wherein the improvement comprises:

said insulator having a first side and a second side facing in generally opposite directions generally in line with the central axis of said helical coil of its respective heating element run and having an intermediate side facing generally toward said run; and said first and second side each having an inclined blind slot therein inclined inwardly and toward said intermediate side, said intermediate side having an intermediate slot therein, said first and second slots and said intermediate slots each being adapted to receive a segment of a respective adjacent convolution of said coil so as to positively prevent axial shifting movement of said coil relative to said insulator.

* * * * *